United States Patent [19]

Fukuda et al.

[11] Patent Number: 4,971,553

[45] Date of Patent: Nov. 20, 1990

[54] BURNER WITH A CYLINDRICAL BODY

[75] Inventors: Shuzo Fukuda; Masahiro Abe, both of Yokohama; Shiro Fukunaka, Fukuyama; Michio Nakayama, Kawasaki; Koichiro Arima, Tama; Shunichi Sugiyama; Koji Matsui, both of Yokohama, all of Japan

[73] Assignee: Nippon Kokan Kabushiki Kaisha, Tokyo, Japan

[21] Appl. No.: 316,351

[22] Filed: Feb. 27, 1989

Related U.S. Application Data

[60] Division of Ser. No. 172,988, Mar. 18, 1988, abandoned, which is a continuation of Ser. No. 856,632, Apr. 24, 1986, abandoned.

[30] Foreign Application Priority Data

| | | | |
|---|---|---|---|
| Apr. 26, 1985 | [JP] | Japan | 60-88731 |
| Aug. 29, 1985 | [JP] | Japan | 60-190327 |
| Aug. 31, 1985 | [JP] | Japan | 60-192606 |
| Aug. 31, 1985 | [JP] | Japan | 60-192607 |
| Aug. 31, 1985 | [JP] | Japan | 60-192609 |
| Aug. 31, 1985 | [JP] | Japan | 60-192610 |

[51] Int. Cl.[5] ..... F23D 14/22; F23D 14/24

[52] U.S. Cl. ..... 431/351; 431/9; 431/116; 431/353; 431/173; 431/182; 431/185

[58] Field of Search ..... 431/173, 182, 185, 187, 431/351, 353, 9, 208, 210, 258, 116; 239/404, 405

[56] References Cited

U.S. PATENT DOCUMENTS

| | | | |
|---|---|---|---|
| 2,973,727 | 3/1961 | Northcote | 431/173 |
| 3,115,851 | 12/1963 | Ceely | 431/185 |
| 3,989,444 | 11/1976 | Staudinger | 431/181 |
| 4,054,409 | 10/1977 | Ando et al. | 431/173 |
| 4,155,701 | 5/1979 | Primas | 239/405 |
| 4,402,036 | 8/1983 | Hensley et al. | 431/258 X |
| 4,629,416 | 12/1986 | Voorheis | 431/173 |

FOREIGN PATENT DOCUMENTS

| | | |
|---|---|---|
| 107425 | 6/1983 | Japan . |
| 26212 | 2/1985 | Japan . |

*Primary Examiner*—Carl D. Price
*Attorney, Agent, or Firm*—Moonray Kojima

[57] ABSTRACT

A burner for directly flaming steel making materials to accomplish reduction without oxidation, wherein the burner comprises a plurality of combustion air outlets spaced circumferentially of the inner wall of a tubular burner tile, and fuel gas outlets disposed centrally of the burner tile, and wherein the combustion air outlets and fuel gas outlets are formed and disposed with specified jetting angles and distances to produce burning without oxidation.

4 Claims, 18 Drawing Sheets

BURNER WITH A CYLINDRICAL BODY

TECHNICAL FIELD

The present invention relates to a burner, and more particularly a burner for directly flaming steel materials with reduction.

These burners are placed in heating zones of continuously annealing furnaces, continuously hot-dip zinc or Al plating facilities and others in order that the heating may be performed without causing oxidation.

BACKGROUND OF THE INVENTION

It is required to carry out the direct flaming of steels in the heating zones without causing oxidation.

Conventionally known burners of this type are a high speed jet burner which directs flames against the steel strip and heat it by convention heat conduction, and on the other hand a radiant cup burner which heats an inner surface of a burner tile at high temperatures for heating the strip by radiant heat conduction therefrom.

The high speed jet burner burns mixture gas in a combustion chamber and jets out a combustion gas at high speed from a throttled nozzle. This burner uses a flow flux of high temperatures in a range of relatively low temperature of the heat material. However, since the flame during combustion reaction directly collides against the strip, slight oxidation is inevitably caused due to $O_2$, O, OH and others existing therein.

The radiant cup burner rapidly burns a mixture of air and fuel gas, which were mixed in advance in a hemispherical cup of the burner tile for providing rapid combustion reaction, so as to increase temperature of the inner surface of the burner tile, and heats the strip by radiant heat conduction from the inner surface. This burner uses a flow flux of high temperatures in a range of high temperature of the heat material. If the fuel gas is burnt at the air ratio of not more than 1.0, it is possible to introduce reducing non-burnt contents such as CO, $H_2$ and others in the combustion gas, and if this combustion gas contacts the strip, it is possible to effect heating without causing oxidation but causing reduction.

Thus, the radiant burner is suitable for heating without causing oxidation. But, since this is of the pre-mixture type system and it is harmful to previously mix air which is pre-heated at the high temperature, in the combustion gas, the combustion air can not be preheated. Therefore, sensible heat of an exhaust gas by pre-heating the air can not be obtained, and so an independent means should be provided for yielding the sensible heat of the exhaust gas to save energy. It is useful to preheat the air for increasing the flame temperature, and it is effective to reduction by CO, $H_2$ to increase the flame temperature. Accordingly, it is not preferable in view of the heating without oxidation not to preheat the air. In addition, provision of a premixture device or a counter-flame checking device causes high costs of equipment.

Further, this kind of burner cannot be used with preheated combustion air, heating without oxidation is limited to a temperature of 750°C., and if heating is required at higher temperatures, this burner is not applicable.

For solving such problems involved with the prior art, there have been proposed Japanese Application Laid Open No. 58-107,425 and Japanese Application Laid Open No. 60-26,212. These burners are defined with a plurality of combustion air jetting outlets in a space circumferentially of an inner wall of a tubular burner tile having an open end, and with fuel gas jetting outlets centrally of the burner tile, and the combustion air jetting outlet is formed in such a manner that the air jetting direction has an angle of not more than 60° with respect to a tangent of the inner circumference of the burner tile. This burner does not require the pre-mixture of the combustion gas and the air, and can heat the strip effeciently. Unfortunately this burner has problems is that the range of the flame is unstable and narrow where the strip is heated without causing oxidation, and is not practical for use in a production line.

In view of these circumstances, it is an object of the invention to provide an improved burner of this kind which eliminates such defects of the prior art. The present invention comprises a burner for directly flaming steel materials for reduction without causing oxidation.

It is another object of the invention to provide a burner form direct flaming for reduction which can use preheated air.

BRIEF DESCRIPTION OF THE DRAWINGS

FIG. 12 is a graph showing the relationship between the angle $\theta 2$ in the air jetting direction and the length of flame, and FIG. 13 is a graph showing distribution of temperature in diameter directions of the burner and another embodiment of the invention;

FIG. 14 is a vertical cross sectional view thereof, and FIG. 15 is a cross sectional view along XV - XV of FIG. 14;

FIG. 20 is a vertical cross sectional view, and FIG. 21 is a front view thereof;

FIG. 22 is a vertical cross sectional view thereof, and FIG. 23 is a cross sectional view along XXII - XXII of FIG. 22;

FIG. 26 is a vertical cross sectional view thereof, and FIG. 27 is a cross sectional view along XXVII - XXVII of FIG. 26;

FIG. 28 is a vertical cross sectional view thereof, and FIG. 29 is a cross sectional view along XXIX - XXIX of FIG. 28;

FIG. 30 is a vertical cross sectional view thereof, and FIG. 31 is a cross sectional view along XXXI - XXXI of FIG. 30;

DISCLOSURE OF THE INVENTION

For accomplishing the above mentioned objects, the burner of the invention is provided with a plurality of air outlets in a space circumferentially of a the inner wall of tubular burner tile having an open end part, and with fuel gas outlets disposed centrally of the burner tile, the combustion air outlets and the fuel gas outlets being composed in such manners that (a) the combustion air outlet is formed such that an air jetting direction has an angle of not more than 60° with respect to a tangent of an inner circumference of the burner tile;

(b) a distance N in an axial direction of the burner between the combustion air outlet and the fuel gas outlet is determined from −0.1D to +0.4D (D: inner diameter of the burner), wherein when the fuel gas outlet is positioned at the side of the exit of the burner tile closer than the combustion air outlet, then the sign is (−), and in the contrary case the sign thereof is (+); and (c) a distance L from the combustion air outlet to the exit of the burner tile is determined from 0.6D to 3D (D: the same)

The thus composed burner forms the non-equilibrium range of the air and the fuel in a determined scope in the flame by controlling the air ratio to be not more than 1.0. That is, the heating burner may rapidly provide combustion by swirling flow of the air from the air outlet and the fuel gas from the center of the burner, and form a range not containing non-reacting free oxygen i.e., non-equilibrium range of the air and the fuel stably and widely, since the flame substantially contains products in the intermediate combustion (intermediate ion, radical and others) over a determined scope outside of the burner exit.

Figure 1:
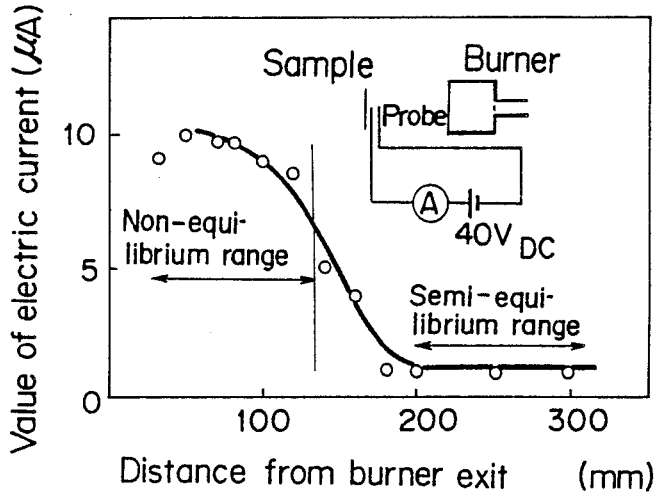
FIG. 1 is a graph showing one example of measuring the scope of non-equilibrium range of the air and the fuel of the burner according to the invention.

FIG. 1 shows one example of the non-equilibrium range of the air and the fuel in the flame to be formed by the burner, as measured with an ion detecting probe, where a high value of electric current implies that an ion strength is large and the range substantially contains products in the intermediate combustion range. According to this fact, the non-equilibrium range is formed over the determined range outside of the burner exit, and outside of this range a semi-equilibrium range is formed containing $CO_2$, $H_2O$, $N_2$ and others.

Figure 2:
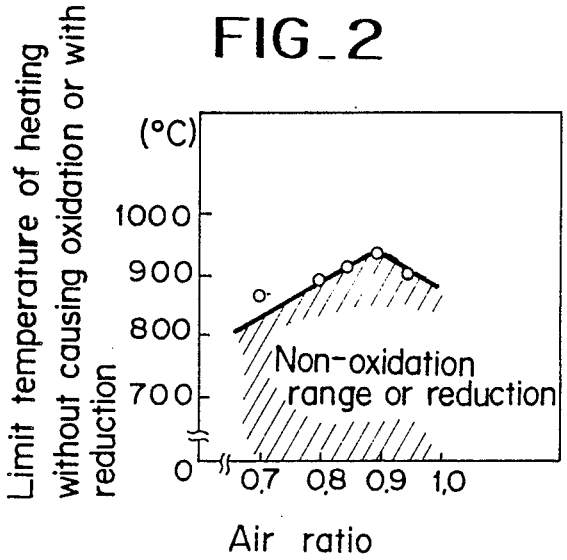
FIG. 2 is a graph showing reduction heating characteristic of the invention.

FIG. 2 shows reduction heating characteristics of the burner, that is, limit temperatures where a steel material may be heated without causing oxidation or with reduction (limit temperature for thin plate or ordinary steel). The present burner may heat the steel strip up to about 900°C. in a range between 0.85 and 0.95 of the air ratio without causing oxidation.

Herein, explanation will now be given as to reasons for limiting the above mentioned conditions (a) to (c).

AS TO (a)

The angle with respect to the tangent of the inner circumference of the burner tile in an air jetting direction is for causing swirling flow in the combustion air within the burner tile. By the swirling flow, a negative pressure range is formed at the inner side of the burner, and by this negative pressure the gas is re-circulated and the combustion is accelerated, so that proper non-equilibrium range may be formed. The air jetting angle is 60° at the maximum, preferably 20° to 40°, thereby effecting stable swirling of the air flow.

AS TO (b):

With respect to the distance N in the axial direction of the burner between the combustion air outlet and the fuel gas outlet when it is (−), (i.e. when the fuel gas outlet 3 is closer to the exit of the body than the air outlet 2), the gas temperature is high and the products of the intermediate combustion are widely distributed, but the free $O_2$ (non-reacting $O_2$) is spread in the axial direction of the burner. It is necessary to minimize the existing distance of the free $O_2$ in the axial direction for appropriately forming the non-equilibrium range which is an object of the invention, and the limit thereof is −0.1D.

Figure 3:
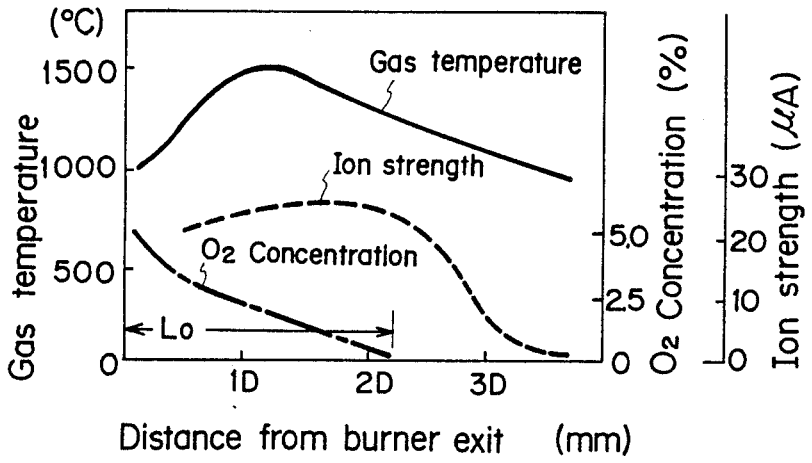
FIG. 3 is a graph showing the relationship between a distance from the burner exit, gas temperature, $O_2$ concentration and ion strength, when distance N in an axial direction of the burner between the fuel gas jetting outlet and the air jetting outlet is −0.25D(D: inner diameter of burner)

FIG. 3 investigates the relationship between the distance in the axial direction from the burner exit, gas temperature within the burner tile, $O_2$ concentration, and ion strength, when the burner axial direction N between the air outlet and the gas outlet is determined to be −0.25D. According to this investigation, it is seen that when N is at the (−) side, the free $O_2$ existing distance $L_O$ in the burner axial direction is large.

Figure 4:
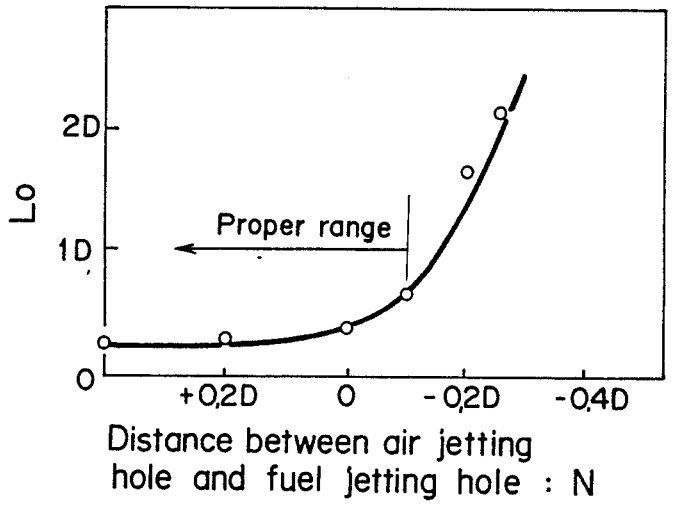
FIG. 4 is a graph showing the relationship between distance N in the burner axial direction from the fuel gas jetting outlet to the air jetting outlet and free $O_2$ existing distance $L_O$ in the burner axial direction.
Figure 5:
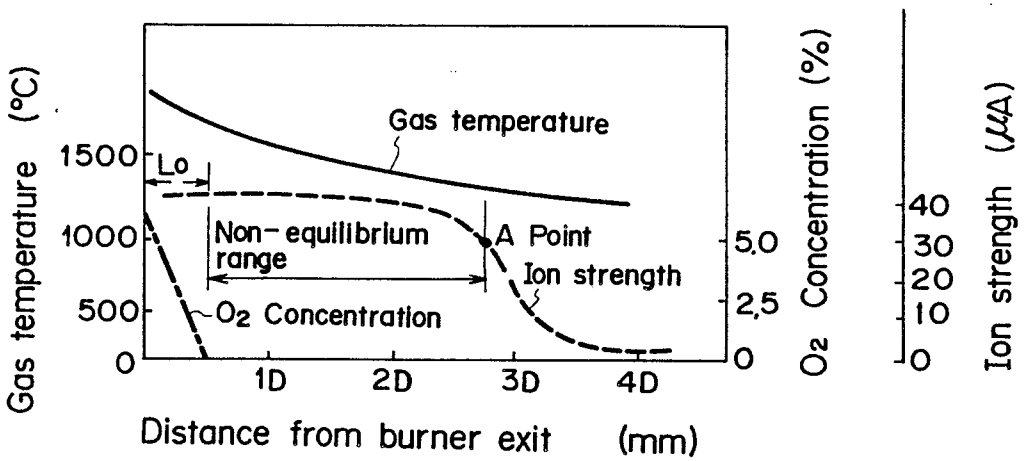
FIG. 5 is a graph showing the relationship between distance from the burner outlet (L), gas temperature, $O_2$ concentration and ion strength, when the distance N is +0.1D.

FIG. 4 shows the relationship between the burner axial distance N from the air outlet to the gas outlet and the free $O_2$ existing distance $L_O$ in the burner axial direction, according to which, if N is larger than −0.1D toward the (−) side, $L_O$ rapidly becomes large, and therefore the limit in the (−) side is −0.1D. FIG. 5 investigates, when N is +0.1D, the relationship between the axial direction from the burner exit, $O_2$ concentration, ion strength and gas temperature.

In FIGS. 4 and 5, when N is at (+) side (i.e. when the fuel gas outlet 3 is further from the exit of the body than the air outlet 2), no problem arises about $O_2$ concentration and the proper non-equilibrium range is formed at the part where the distance from the burner exit is more than 0.5D.

When N is at the (+) side, the proper non-equilibrium range is formed, but if it exceeds +0.4D, the air and the fuel are not fully mixed. The present burner accelerates the mixture of both by jetting the fuel gas from the center thereof into the rapid swirling of the air, and if N is made extraordinarily large, the accelerating action of mixture could not be fully obtained, so that the non-equilibrium range could not be stably formed. Thus, the upper limit of N is +0.4D.

Figure 8:
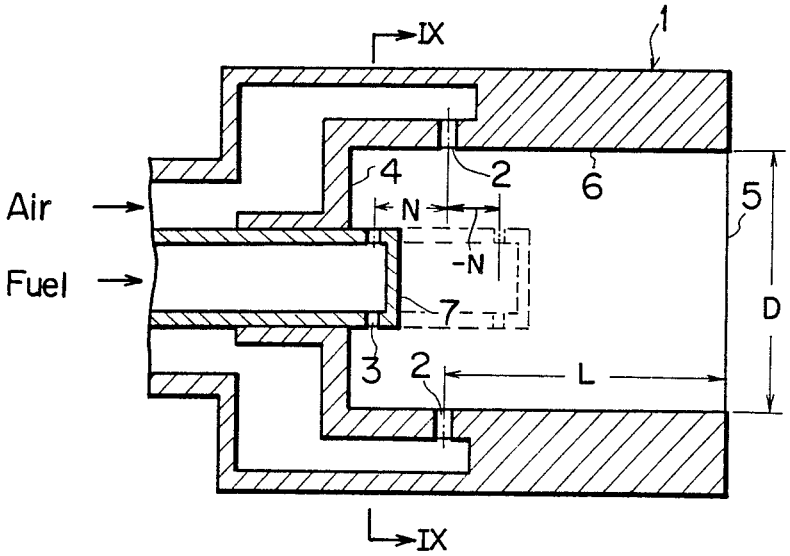
FIG. 8 is a vertical cross sectional view of the heating burner of the invention.

From the above mentioned, the axial distance N in the center of the burner between the fuel gas outlet and the air outlet is in the scope from −0.1D to 0.4D. To put this another way, as depicted in FIG. 8, the air outlet 2 and fuel gas outlet 3 can be disposed or located with respect to one another so that the axial distance N therebetween is anywhere within the range of N=0 to 0.1D when the fuel gas outlet 3 is located to be closer to the exit of the body than the air outlet 2, and within the range of N=0 to 0.4D when the fuel gas outlet 3 is located to be further from the exit of the body than the air outlet 2. In both cases, N=0 when the air outlet 2 and fuel gas outlet 3 are at the same axial position, and D is the inner diameter of the body.

Figure 6:
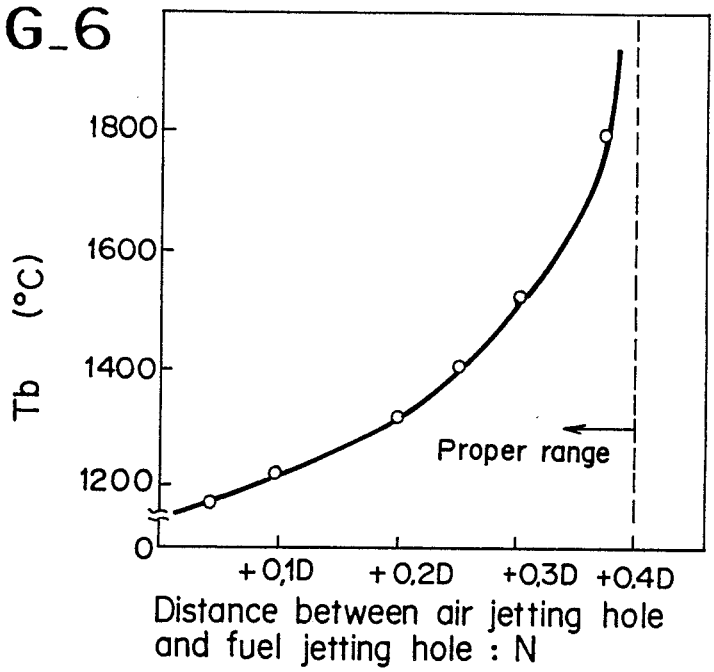
FIG. 6 is a graph showing the relationship between distance N from the fuel gas jetting outlet to the air jetting outlet and temperature (Tb) of a backward wall of the burner tile.

Further, as N becomes larger, the temperature of the inner wall of the burner tile becomes higher. FIG. 6 shows the relation between the distance N and the temperature Tb of the inner wall of the burner tile. When N is +0.25D, Tb is 1400°C., and in general ordinary heat resisting materials may be used up to around this temperature. When N is +0.4D, the temperature of the inner wall is heightened till more than 1800°C., and in such a case, high heat resisting material is used for the burner tile material.

AS TO (c)

The distance L from the air outlet to the burner tile exit has a close relation with the scope of the non-equilibrium range of the air and the fuel. If L exceeds 3D, the non-equilibrium range is formed only just after the burner tile exit, and if L is less than 6D, the flame becomes like flower petals just after the burner tile exit, so that the non-equilibrium range is not properly formed in the center line of the burner. Thus, L is determined 0.6D to 3.0D.

When the thin steel plate is continuously heated and if a distance between the burner tile exit and the steel plate were not obtained to be more than a certain length (normally more than about 100 mm), the steel plate would contact the burner when passing the line. Therefore, it will be preferable to form the non-equilibrium range in the flaming in a scope as wide as possible including the strip passing route which exists from the bruner unit to a determined position.

Figure 7:
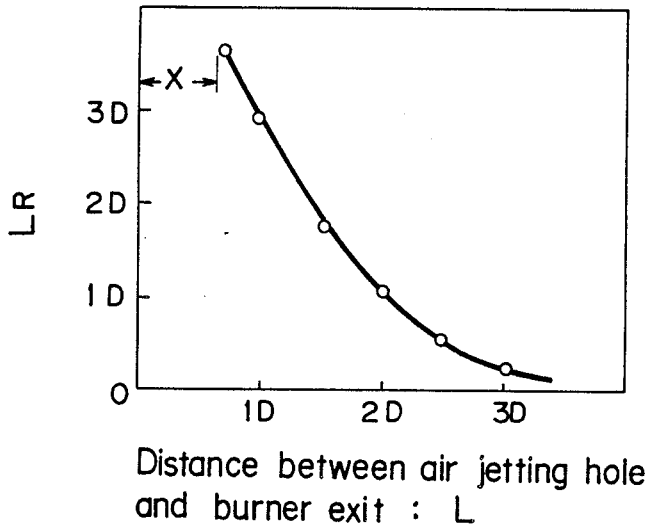
FIG. 7 is a graph showing the relationship between distance L from the air jetting outlet to the burner exit and distance $L_R$ until termination of non-equilibrium range of the air and the fuel.

FIG. 7 studies the relationship between said distance L and the termination of the non-equilibrium range from the burner exit (an end opposite to the burner side, for example, A point of FIG. 5). If L exceeds 3D, the non-equilibrium range is formed only just after the burner tile exit and scarcer in a forward side than said exit. The non-equilibrium range is expanded as L becomes smaller, and when L is in the scope (X) of less than 0.6D, the flame is, as mentioned, shaped like the flower petal.

EXAMPLES

Figure 9:
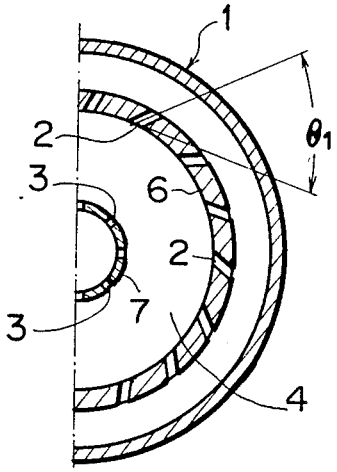
FIG. 9 is a cross sectional view along IX - IX of FIG. 8.

FIGS. 8 and 9 show an embodiment of the invention, where a numeral 1 designates a tubular tile as a main body having an exit 5 at one end, and the burner is provided with a plurality of air outlets 2 in a space circumferentially of the inner wall 6 of tubular burner tile and with fuel gas outlets 3 disposed centrally of the burner tile. In this embodiment, an inner end wall 4 of the burner tile 1 is projected with a fuel gas nozzle 7, and the fuel as nozzle 7 is defined with a plurality of fuel gas outlet 3 toward the diameter of the burner tile 1 in a space circumferentially of said nozzle 7.

In this structure, the combustion air outlet 2 and the fuel gas outlet 3 are composed as follows:

(a) the combustion air outlet 2 is formed such that an air jetting direction has an angle 81 of not more than 60° with respect to a tangent of an inner circumference of the burner tile;

(b) a distance N in an axial direction of the burner between the combustion air outlet 2 and the fuel gas outlet 3 is determined to be from −0.1D to +0.4D (D: inner diameter of burner), wherein when the fuel gas outlet is positioned at the side of the exit of the burner tile closer than the combustion air outlet 2, the sign is (−) and in a contrary case thereof the sign is (+); and (c) a distance L from the combustion air outlet 2 to the exit of the burner tile is determined to be from 0.6D to 3D (D:the same).

As depicted, the fuel gas outlet can be located with respect to the air outlet 2 at any position between +N (as shown in solid line) and −N (as shown in dotted line). Of course, either of the gas outlet 3 or the air outlet 2 or both, may be suitably placed as desired. All of the embodiments in the remaining figures of the drawing are understood to have similar structural features even though the dotted lines are not shown in the remaining figures.

Figure 10:
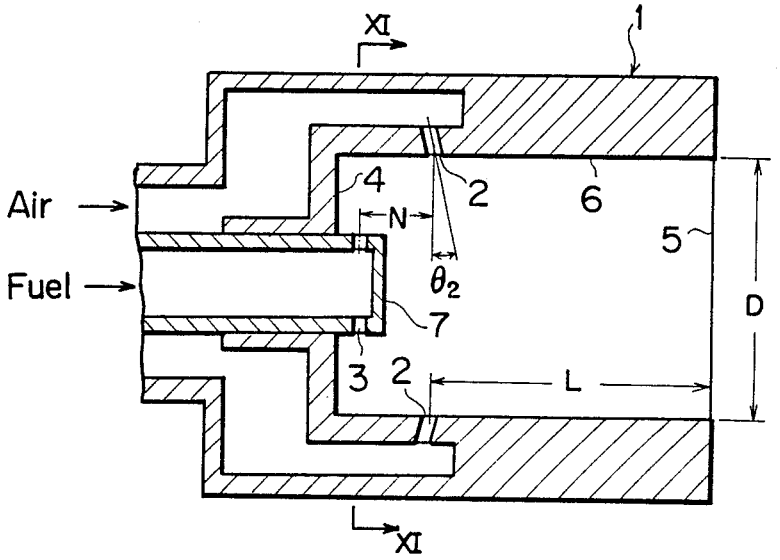
FIG. 10 is a vertical cross sectional view of another embodiment of the invention.
Figure 11:
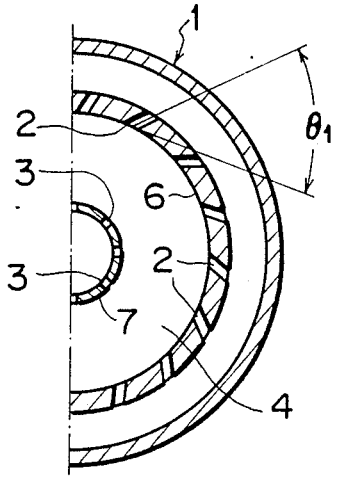
FIG. 11 is a cross sectional view along XI - XI of FIG. 10.

FIGS. 10 and 11 show another embodiment of the invention, and the combustion air outlet 2 is formed such that an air jetting direction has an angle $\theta 1$ of not more than 60° with respect to the tangent of the inner circumference of the burner tile, and it has a twisting angle $\theta 2$ of not more than 30° directing to the diameter of the burner tile and toward the exit thereof. Due to such a structure, it is possible to more uniformalize the temperature distribution of the flame issued from the burner outlet, and to appropriately control deviations of reducing characteristics and heating characteristics. By the angle $\theta 1$, the combustion air is caused with swirling flow within the burner tile, thereby to realize rapid combustion and form a reducing range including products of an intermediate reaction. When the combustion air is supplied along the circumferential direction of the burner because of the angle $\theta 1$, the swirling force will be so strong as to cause a negative pressure scope in the flame and deviation in the temperature distribution. Thereupon, in this embodiment, the air jetting direction is tilted toward the burner axial direction (the burner exit), so that the swirling force of the air is weakened in the diameter direction in order to uniformalize the temperature distribution of the flame.

Figure 12:
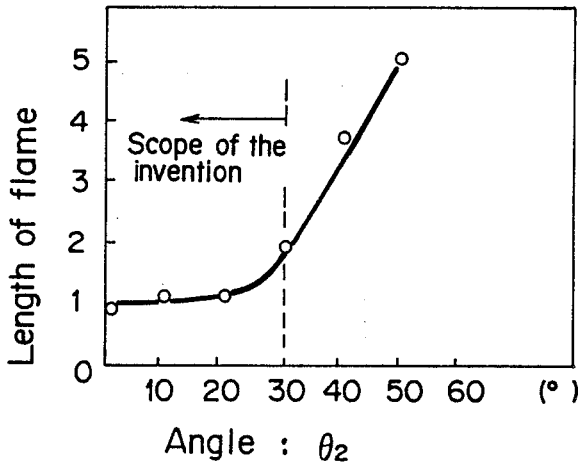
FIGS. 12 and 13 are graphs showing reduction heating characteristics of the burner shown in FIGS. 10 and 11, where

The oblique angle $\theta 2$ in the air jetting direction is preferably maintained to be more than 10° for uniformalizing the proper temperature range, however, if the angle were too large, it would be difficult to obtain the swirling force in the diameter direction. The rapid combustion as an object could not be obtained and the length of the flame would be too large, and the stable non-equilibrium range could not be obtained. Especially, if $\theta 2$ exceeds 30° as shown in FIG. 12, the flame is considerably lengthened and the non-equilibrium range is very unstable. Therefore $\theta 2$ should be in a scope of not more than 30°.

Figure 13:
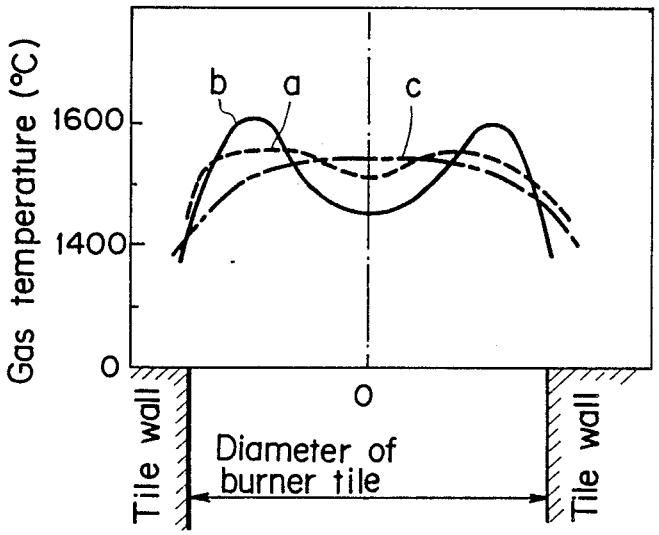

FIG. 13 is an example showing the gas temperature distribution in the diameter of the burner between the present burner ($\theta 1$: 30°, $\theta 2$: 15°) and the burner without $\theta 2$ in the air jetting direction ($\theta 1$: 30°, $\theta 2$: 0°) shown in FIG. 8. In the same, a chain line (a) shows the present embodiment and a solid line (b) shows the burner of the structure of FIG. 8. The burner shown in FIG. 8 has a large depression which is due to the negative pressure, in the center of the burner, while the burner of the present embodiment has been improved in such a depression of the temperature and shows the relatively uniform temperature distribution in the diameter direction.

Figure 14:
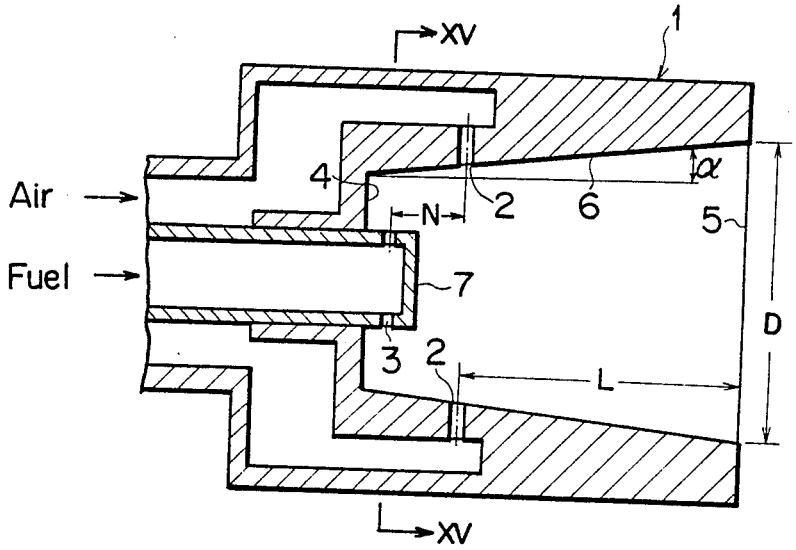
FIGS. 14 and 15 show another embodiment of the invention, where
Figure 15:
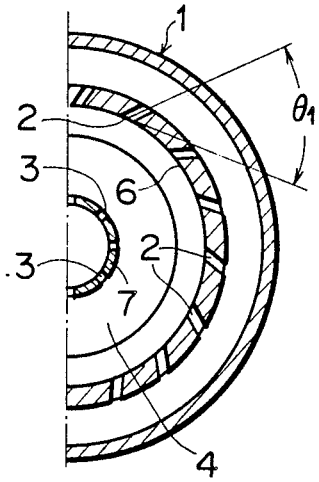

FIGS. 14 and 15 show another embodiment of the invention, where the inner wall 6 of the burner tile is provided with an expanding angle $\alpha$ in the exit so as to form a tapered inner wall. The inner wall part given this expanding angle $\alpha$ is formed at the exit with at least a part forming the combustion air outlet. By giving the angle $\alpha$, the flame from the burner outlet is widely spread for the steel plates.

Figure 16:
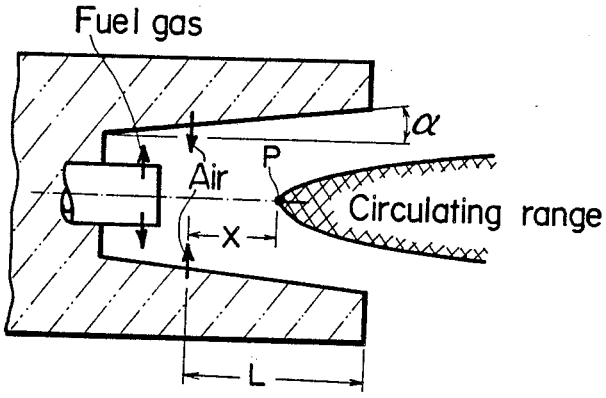
FIG. 16 is an explanatory view showing a circulating range of the air and the fuel to be formed in the burner shown in FIGS. 14 and 15.

The burner of the invention causes the swirling flow of the combustion air within the burner tile, and this swirling flow forms a circulating range of the air and the fuel gas, and this circulating range effects rapid combustion. If the expanding angle $\alpha$ is made larger, the circulating range (negative pressure range) as shown in FIG. 16 is formed outside of the burner so that it is difficult to accomplish rapid combustion. The circulating range controls the rapid combustion, and the forming of the rapid combustion within the burner tile results in a stable forming of non-equilibrium rang for reduction heating at the burner exit.

Figure 17:
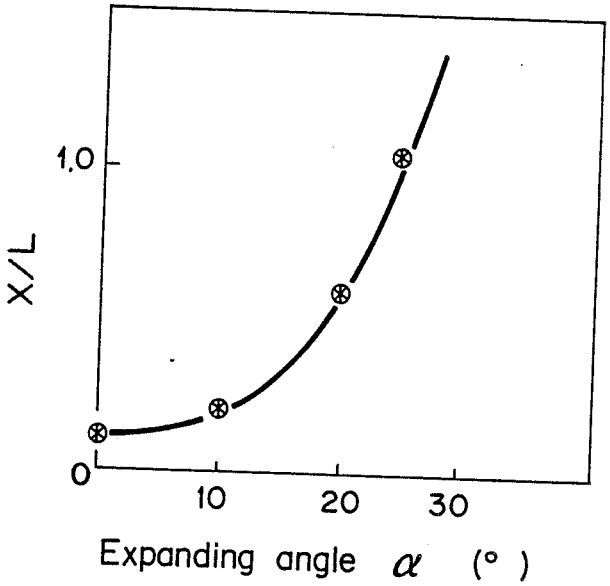
FIG. 17 is a graph showing the relationship between expanding or taper angle $\alpha$ and X/L (end point (P) of the circulating range) of FIG. 16.

FIG. 17 shows the relationship between the expanding angle $\alpha$ and the end point of the circulating range (P) (refer to FIG. 16), and "X/L=1" implies that the end point (P) meets the burner exit 5, according to which, the end point (P) comes near to the burner exit when the expanding angle $\alpha$ is about ±25°, and therefore it is preferable to form the expanding angle $\alpha$ to be not more than 25°.

Figure 18:
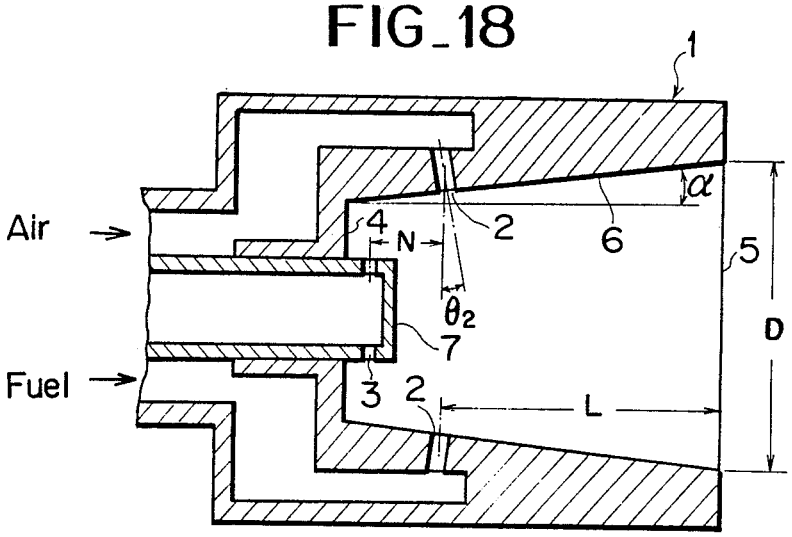
FIG. 18 is a vertical cross sectional view showing another embodiment of the invention.

FIG. 18 is an embodiment which is formed with an oblique angle $\theta 2$ of the combustion air outlet 2 together with the expanding angle $\alpha$.

Figure 19:
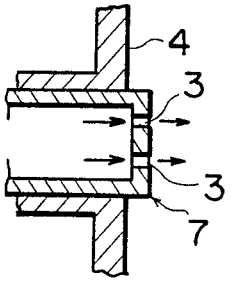
FIG. 19 is a vertical cross sectional view showing another embodiment of a fuel gas nozzle of the invention.

With respect to the above mentioned structures as shown in FIGS. 8 and 9, FIGS. 10 and 11, and FIGS. 14 and 15, the gas outlet 3 is formed at the interior of the burner tile as shown in FIG. 19 such that the fuel gas is jetted along the axial direction of the burner, thereby to moderate the swirling force and uniformalize the temperature distribution of the burner flame.

A one dotted line (c) of FIG. 13 shows the temperature distribution of the flame in the burner diameter when the structure of FIG. 19 is applied to the burner of FIGS. 10 and 11, and it is seen that the distribution is more uniformalized than the above mentioned ones.

Figure 20:
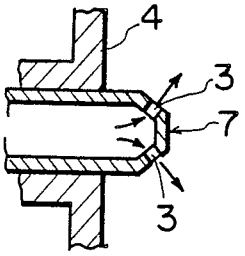
FIGS. 20 and 21 show another embodiment of the gas nozzle of the invention, where
Figure 21:
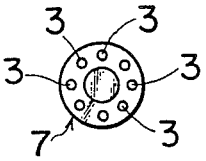

As shown in FIGS. 20 and 21, fuel gas outlets 3 may be formed such that the gas is jetted in an oblique direction. Further, the fuel gas outlet 3 may be of course incorporated in the structures as shown in FIGS. 8 to 18, FIG. 19 and FIGS. 20 and 21. For example, the gas outlet may be defined plurally in the circumference of the fuel gas nozzle, and one or plurality in the front of the nozzle 1.

Figure 22:
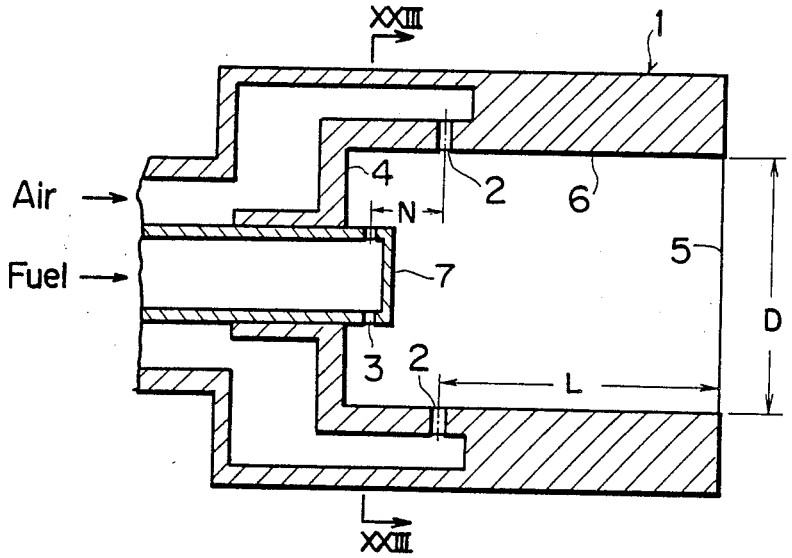
FIGS. 22 and 23 are another embodiment of the invention, where
Figure 23:
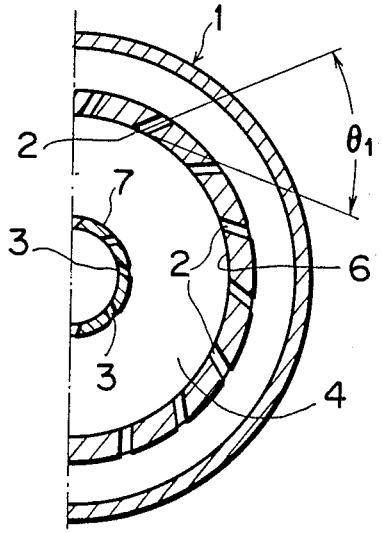
Figure 25:
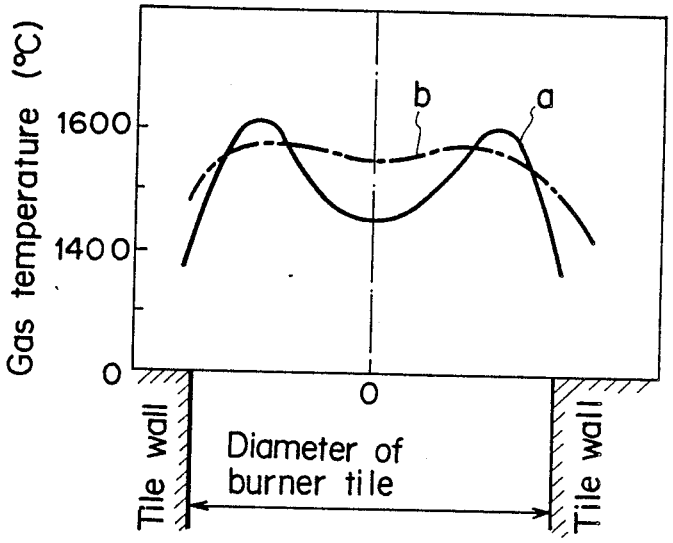
FIG. 25 is a graph showing distribution of temperature in the burner diameters and another embodiment of the invention.

FIGS. 22 and 23 show a burner where a plurality of fuel gas outlets 3 are formed in a fuel gas nozzle 7 in a space circumferentially which is projected centrally of a burner tile 1, the fuel gas outlet 3 being formed such that the gas jetting direction is non-right angled with respect to a tangent of the outer circumference of the gas nozzle and the gas swirling flow thereby is opposite to the air flow from the air outlet 2 as shown in FIG. 25(*b*).

By forming the fuel gas swirling flow opposite to the combustion air swirling flow, it is possible to more uniformalize the temperature distribution of the flame from the burner exit 5 and appropriately control the deviation of the reducing characteristics and the heating characteristics. As mentioned above, when the combustion air is supplied along the circumferential direction of the burner because of the angle $\theta 1$, the swirling force will be so strong as to cause the negative pressure scope in the flame and the deviation in the temperature distribution. Thereupon, in this embodiment, the swirling flow of the fuel gas in opposition to the air swirling flow is positively formed, thereby to weaken the swirling force of the air in the diameter direction and uniformalize the flame temperature distribution.

Figure 24A:
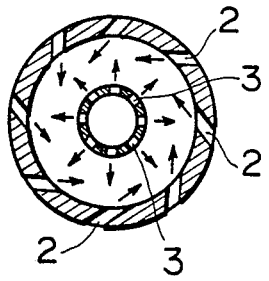
FIG. 24(*a*) and (*b*) are explanatory views showing the jetting directions of the combustion air and the fuel gas of other embodiments of the invention and the embodiments of FIGS. 22 and 23.
Figure 24B:
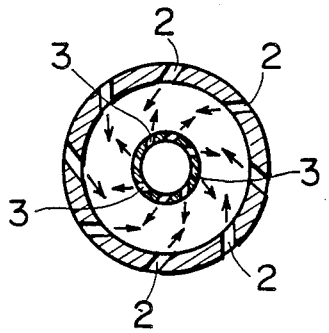

FIG. 25 shows an example of a gas temperature distribution in the burner diameter between the burner of this embodiment shown in FIG. 24(*b*) and a burner of another embodiment of FIG. 24(*a*). A one-dotted line (b) designates the present embodiment and a solid line (a) designates another embodiment. As is seen, the burner shown with the solid line (a) has a large depression which is due to the negative pressure, in the center of the burner, while the burner of this embodiment has been improved in such a depression of the temperature and shows the relatively uniform temperature distribution in the diamter direction.

Also in this embodiment, an oblique angle directing to the diameter of the burner and toward the exit thereof may be given in the air jetting direction of the air outlet 2 and the fuel gas jetting direction of the fuel outlet 3, as shown in FIGS. 10 and 20. The inner wall part given the expanding angle $\alpha$ is formed at the exit with at least a part forming the combustion air outlet. By giving the angle $\alpha$, the flame from the burner outlet is widely spread for the steel plates.

Each of embodiments shown in FIG. 21 and the rest is provided with a combustion air swirling path 8 following a burner circumferential direction in the wall of the tubular burner tile 1 having an open end and with a plurality of combustion air outlets 2 guiding path 8 to the interior of the burner, so that the air jetting direction has an angle of not more than 60° with respect to a tangent of the inner circumference of the burner tile.

Figure 26:
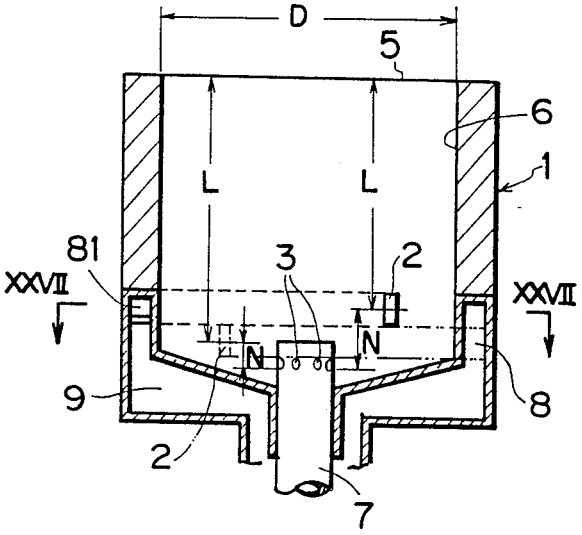
FIGS. 26 and 27 show another embodiment of the invention, where
Figure 27:
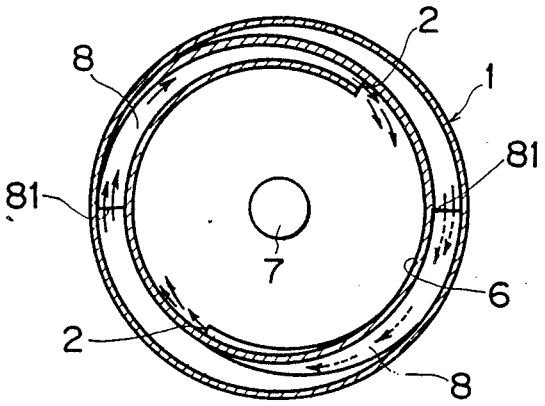

In the embodiment shown in FIGS. 26 and 27, the two swirling paths 8 are formed in opposition in the circumferential direction. Each of the swirling paths 8 becomes narrower as running clockwise in FIG. 27 and is formed at termination with the combustion air outlet 2 for communicating with the interior of the burner tile. On the other hand, the rear end thereof is opened to an air chamber 9 provided at a rear end of the burner tile so as to form an air inlet 81 for the swirling path 8.

Figure 28:
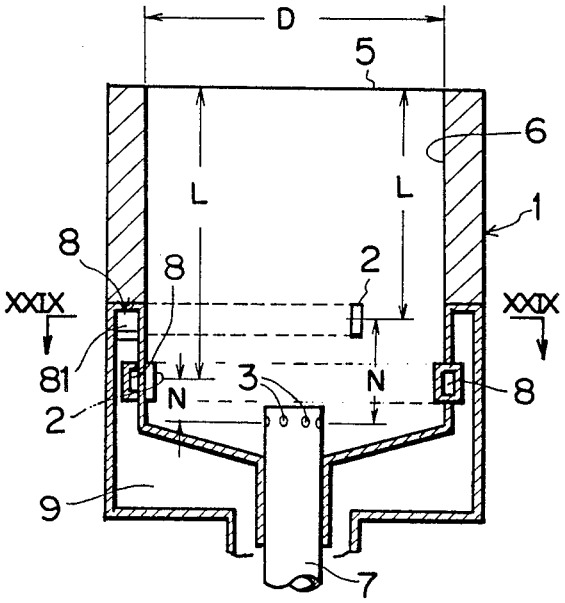
FIGS. 28 and 29 show another embodiment of the invention, where
Figure 29:
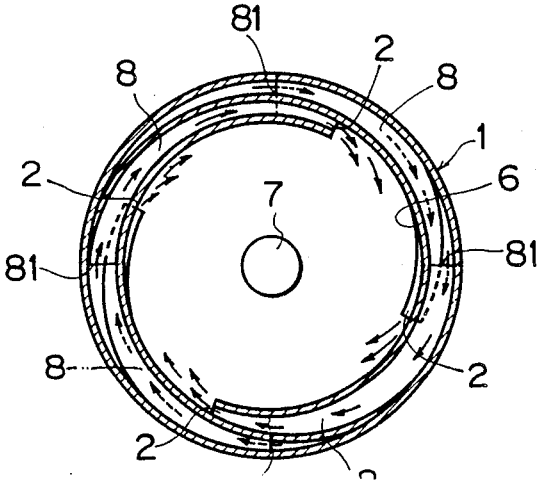

FIGS. 28 and 29 show another embodiment of the invention, where four swirling paths 8 are provided circumferentially of the burner with partial over lap at upper and lower parts, and combustion air outlets 2 are provided at terminations of the paths 8.

In each of the embodiments shown in FIGS. 26, 27 and 28, the air outlet 2 may also be formed on the way of the path 8.

Figure 30:
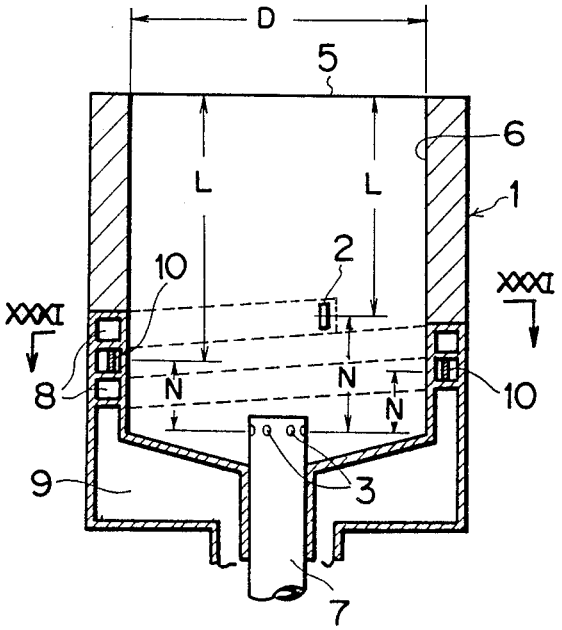
FIGS. 30 and 31 show another embodiment of the invention, where
Figure 31:
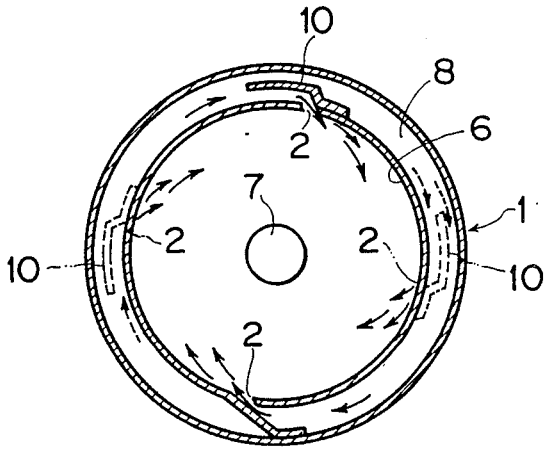

FIGS. 30 and 31 show another embodiment of the invention, where a swirling path 8 is formed in one spiral swirling path to be provided circumferentially of the burner so as to form an air outlet 2 in a space in the circumferential direction of the spiral path 8. In this embodiment, rectifier guide plates 10 are furnished in the air outlets 2 within the flowing paths.

In the above mentioned three embodiments, the combustion air runs in the spiral swirling path 8, thereby to effect the swirling force circumferentially of the burner, so that the air jetted from the air outlet becomes a swirling flow within the burner. By this swirling flow, a negative pressure range is formed at the inside of the burner, and by this negative pressure the gas is re-circulated so that the combustion is accelerated, and a desirous non-equilibrium range is formed. Especially in the instant embodiment, the swirling flow is formed by the swirling path 8 prior to jetting, and since it may be led to the interior of the burner from the air outlet, an air swirling flow having large kinetic energy may be provided within the burner.

Figure 32:
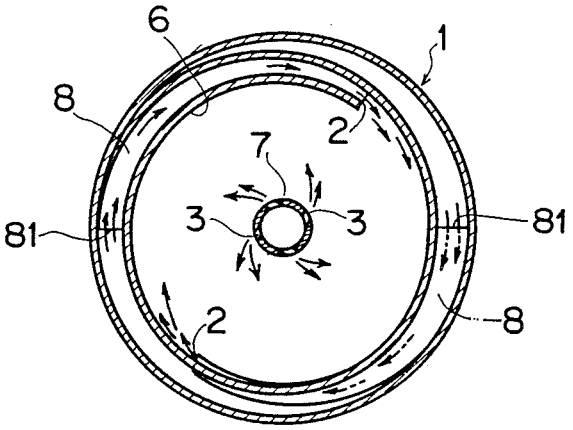
FIG. 32 is a cross sectional view showing another embodiment of the invention.
Figure 33:
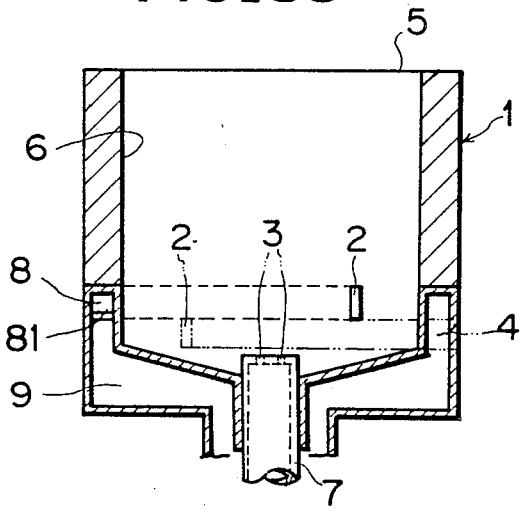
FIG. 33 is a vertical cross sectional view showing another embodiment of the invention.
Figure 34:
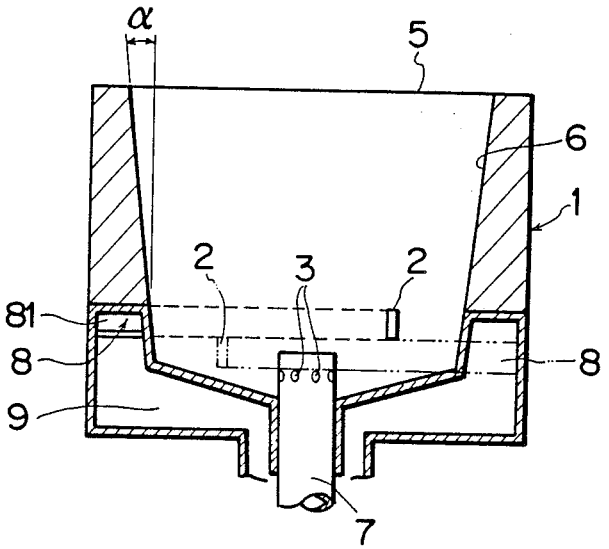
FIG. 34 is a vertical cross sectional view showing another embodiment of the invention.

FIGS. 32 to 34 show various modified embodiments. In FIG. 32, the gas outlet 3 to be provided circumferentially of the nozzle 7 is formed such that the gas jetting direction is non-right angled with respect to a tangent of the outer circumference of the gas nozzle, and the gas swirling flow thereby is opposite to the air flow from the air outlet 2, that is, collides against the air swirling flow.

FIG. 33 shows that a combustion gas outlet 3 is furnished in front of a gas nozzle in the burner tile, so that a fuel gas is jetted along a burner axial direction (toward the burner exit). In such a manner, the swirling force of the air flow is moderated and the same effect as in FIG. 32 may be obtained. The gas outlet 3 of the gas burner 7 may tilt its gas jetting direction at a proper outward angle with respect to the burner axial direction as seen in FIGS. 20 and 21. The gas outlet 3 is given an angle in the jetting direction as seen in FIG. 32, so that the gas flow may swirl in opposition to the air swirling flow. The gas outlet 3 may be appropriately associated with those shown in FIGS. 1, 20 and 33.

FIG. 34 shows that an inner diameter of the burner is expanded toward the burner exit with an angle $\alpha$ in the inner wall of the end exit than at least the air outlet.

The operating effect by the structure shown in FIGS. 32 to 34 are the same as those above mentioned.

As a modified embodiment, such a structure may be taken up which is associated with an injection mechanism of plasma gas.

Figure 35:
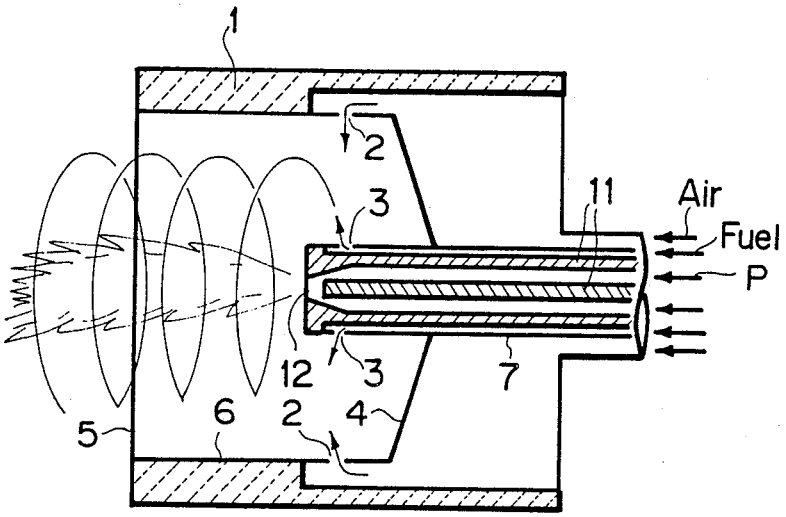
FIG. 35 is a vertical cross sectional view showing another embodiment of the invention.

FIG. 35 shows an electrode couple 11, composed of a tubular electrode and an electrode inserted therein, incorporated centrally of a fuel gas nozzle 7, and a plasma gas (P) supplied between the electrodes is jetted into the interior of the burner from an outlet 12 of the nozzle.

In such a manner, the flame temperature of the burner can be increased and the flame of high temperatures can collide against the steel material. The plasma gas (P) supplied in the nozzle is heated up to super high temperatures between the electrodes, and is injected into the swirling flame within the burner. Thus, the flame temperature is heightened to be more than 2000°C. so that the steel may be heated at high efficiency.

The plasma gas (P) is single of $H_2$, Ar, $N_2$, He,$CH_4$ or $O_2$, or gas of a coke oven, furnace or converter, which is by-product in steel making processes.

Figure 36:
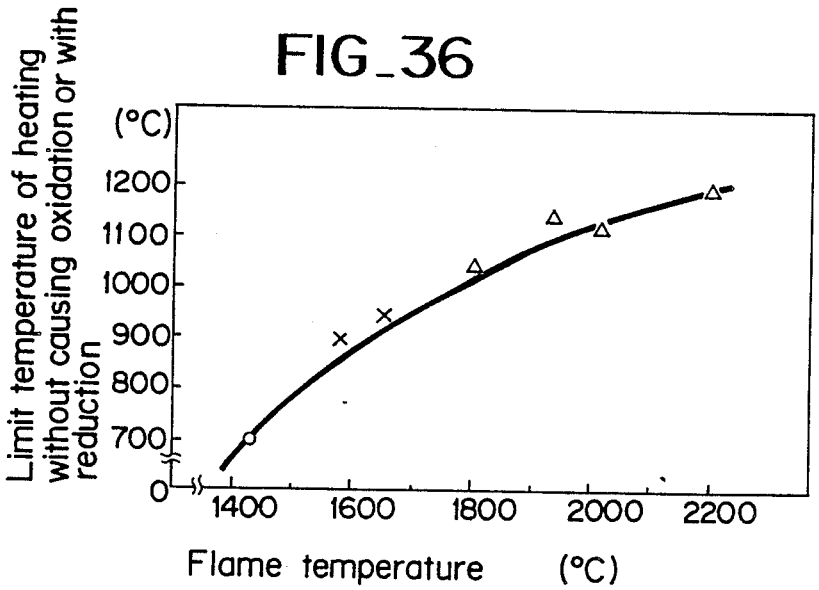
FIG. 36 is a graph showing comparison between the heating characteristic of the burner of FIG. 35 and another embodiment of the invention.

FIG. 36 shows the relationships experimentally obtained between the flame temperature just after the burner tile exit shown in FIG. 35 and limit temperatures of heating the steel plate with no oxidation and with reduction.

In the experiments, the air ratio during combustion was constantly 0.9 and the fuel was the gas of the coke oven. When the plasma was used, the plasma gas was the coke oven gas, and its supply amount was 10% of the total amount used. The strength of the plasma was controlled by electric power, and it was from 0.5Kw to 3.2Kw in the experiments.

In FIG. 26, O mark shows C gas - the normal air, X mark shows C gas - the preheated air, and $\Delta$ mark shows C gas - plasma - the preheated air. The temperatures of the preheated air are 400°C. to 600°C. If the plasma is added to heighten the flame temperature about 2200°C., it is confirmed that the steel may be heated without causing oxidation up to about 1200°C.

In the plasma gas injection mechanism of the said embodiments, the electrode couple 11 is incorporated in the fuel gas nozzle 7 and this nozzle is provided with a plasma jetting outlet, independently of the fuel gas jetting outlet, thereby to be easily incorporated in the burner.

What is claimed is:

1. A burner for producing direct flames to obtain reduction, comprising a cylindrical body having an inner wall and an open end exit; at least one combustion air outlet disposed in a space circumferentially of said inner wall of said body; and a gas nozzle comprising at least one fuel gas outlet disposed centrally of the body; the inner diameter of the body increasing from a point at which is located the combustion air outlet toward the exit; wherein said at least one combustion air outlet and said at least one fuel gas outlet are constructed in such a manner that (a) said at least one combustion air outlet is formed such that an air jetting direction has an angle of not more than 60° with respect to a tangent of an inner circumference of said body;

(b) the combustion air outlet is positioned at an axial direction N from the fuel gas outlet in a range of N=0 to 0.1D when the fuel gas outlet is closer to the exit of the body than the air outlet, and in a range of N=0 to 0.4D when the fuel gas outlet is further from the exit of the body than the air outlet, wherein D is the inner diameter at the open end exit of the body, and N=0 when the air outlet and the fuel gas outlet are at the same axial position; and (c) a distance L from the combustion air outlet to the exit of the body is determined to be from 0.6D to 3D, wherein D is the inner diameter at the open end exit of the body.

2. A burner as claimed in claim 1, wherein an injection mechanism is provided for heating plasma gas at high temperatures so as to apply a plasma jet of high temperatures to the interior of the burner.

3. A burner for producing direct flames to obtain reduction, comprising a cylindrical body having an inner wall and an open end exit; at least one combustion air outlet disposed in a space circumferentially of said inner wall of said body; and a gas nozzle comprising at least one fuel gas outlet disposed centrally of the body; the inner diameter of the body increasing from a point at which is located the combustion air outlet toward the exit; wherein said at least one combustion air outlet and said at least one fuel gas outlet are constructed in such a manner that (a) said at least one combustion air outlet is formed such that an air jetting direction has an angle of not more than 60° with respect to a tangent of an inner circumference of said body;

(b) the combustion air outlet is positioned at an axial direction N from the fuel gas outlet in a range of N=0 to 0.1D when the fuel gas outlet is closer to the exit of the body than the combustion air outlet, and in a range of N=0 to 0.4D when the fuel gas outlet is further from the exit of the body than the combustion air outlet, wherein D is the inner diameter at the open end exit of the body, and N=0 when the combustion air outlet and the fuel gas outlet are at the same axial position; and (c) a distance L from the combustion air outlet to the exit of the body is determined to be from 0.6D to 3D, wherein D is the inner diameter at the open end exit of the body; wherein an injection mechanism is provided for heating plasma gas at a high temperature so as to apply a plasma jet of high temperature to the interior of the burner.

4. A burner as claimed in claim 3, wherein an electrode couple is provided within the fuel gas nozzle for heating the plasma gas, and paths and outlets for the plasma gas are formed independently of the paths and the outlets for the fuel gas.

* * * * *